United States Patent [19]

Hanson

[11] 4,071,433

[45] Jan. 31, 1978

[54] RECOVERY OF OIL FROM TAR SANDS

[75] Inventor: Donald O. Hanson, Bartlesville, Okla.

[73] Assignee: Phillips Petroleum Company, Bartlesville, Okla.

[21] Appl. No.: 736,283

[22] Filed: Oct. 28, 1976

[51] Int. Cl.[2] ..... C10G 1/04; C10B 57/04; C10G 9/00

[52] U.S. Cl. ..... 208/11 LE; 201/20; 208/106

[58] Field of Search ..... 208/11 LE, 46, 106; 201/25, 20

[56] References Cited

U.S. PATENT DOCUMENTS

| | | | |
|---|---|---|---|
| 2,772,209 | 11/1956 | Stewart et al. | 208/11 LE |
| 3,466,240 | 9/1969 | Steinmetz | 208/11 LE |
| 3,480,540 | 11/1969 | Eng et al. | 208/11 R |
| 3,607,720 | 9/1971 | Paulson | 208/11 LE |

FOREIGN PATENT DOCUMENTS

| | | | |
|---|---|---|---|
| 878,656 | 8/1971 | Canada | 208/11 R |

*Primary Examiner*—Delbert E. Gantz
*Assistant Examiner*—James W. Hellwege

[57] ABSTRACT

Tar sand is blended in a melt tank with oil to form a slurry which is separated into two streams one containing coarse sand, the other fine sand. The stream containing fine sand is then introduced into a coker yielding coke and a hydrocarbon vapor stream, the latter is introduced into the bottom section of a fractionator. The stream containing coarse sand is filtered. The sand is stripped with kerosine which is then fed to the fractionator together with the filtrate at intermediate points. The fractionation produces gas, gasoline, kerosine and various cuts of oil including heavy bottoms which are recycled to the coker and heavy gas oil which can be recycled to the melt tank.

7 Claims, 1 Drawing Figure

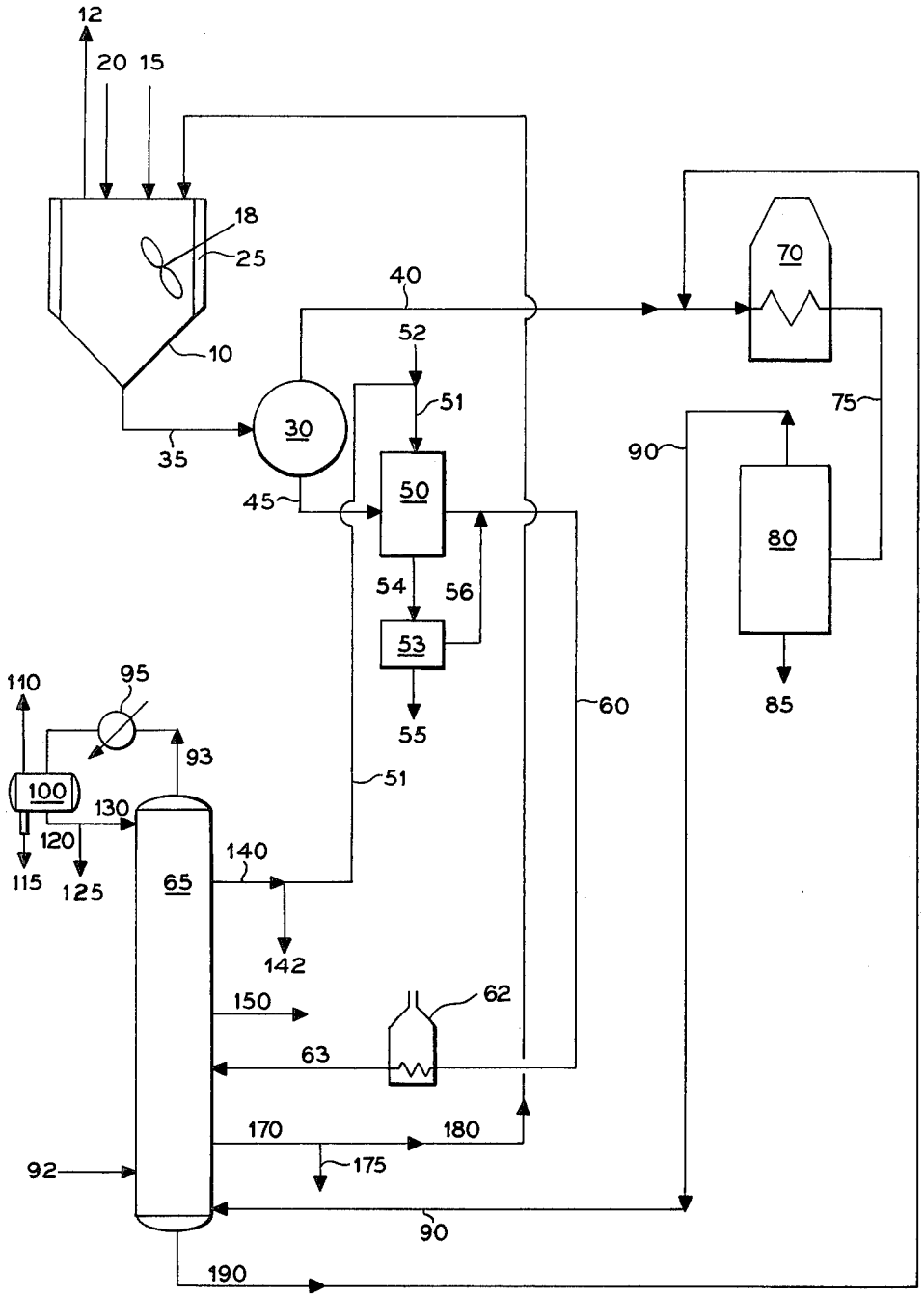
12
20
15
18
25
10
35
30
40
52
51
45
50
54
56
53
55
70
75
90
80
85
60
110
95
93
100
130
120
115
125
65
140
142
150
62
63
170
180
175
92
90
190

RECOVERY OF OIL FROM TAR SANDS

BACKGROUND OF THE INVENTION

This invention relates to a method for recovery of oil from tar sands. In particular, it relates to an improved liquid slurry process for recovery of oil from tar sands.

Tar sands, also known as oil or bituminous sands, are sands that are heavily impregnated or saturated with oil. Deposits of these sands are found in many areas of the world including Utah, California, and Alberta, Canada. Although tar sands provide a potentially attractive source of petroleum products, the recovery of valuable components from tar sands in an efficient and economical manner has been a problem. One process for recovery of oil from tar sands is disclosed, for example, in U.S. Pat. No. 2,772,209 and U. S. Pat. No. 3,392,105 comprises adding a diluent to tar sand to form a slurry. The slurry is then heated or introduced into a cyclone as disclosed in U.S. Pat.No. 2,910,424 to achieve separation of oil. One problem encountered by these processes is that tar sand has a high percentage of inorganic solids. The solid particles are of different size ranges so that a complete separation of solids necessitates the use of sophisticated, expensive and energy consuming devices such as centrifuges. A substantially complete removal of solids in a filter zone is impractical because smaller size particles accumulate on the filter restricting the flow rate and resulting in plugging the filter. The expense associated with substantially complete removal of solid particles leads to compromises in the level of solids removed which in turn results in production of oil having high ash content and therefore not suitable for some applications.

One process for the recovery of oil from tar sands includes making a slurry in a melt tank utilizing oil as a solvent. The slurry is then passed to a centrifugal classifier in which it is subdivided into an underflow stream containing coarse sand particles and an overflow stream containing fine sand particles. The underflow stream is passed through a solids removal zone, such as a hot oil filter and the filtrate of that stream combined with the overflow stream is introduced into a coker. The fine sand contained in the combined stream acts as nuclei in coke forming reaction. The coke is removed from the system. The vapors formed in the coking process are condensed and then fed into a fractionator which produces gasoline, naphtha, kerosine, high boiling oil fractions and heavy bottoms. The heavy bottoms and high boiling oil fractions can be recycled from the fractionator to the melt tank.

This invention obviates some of the problems inherent in the processes for recovery of oil from tar sands utilizing oil as a solvent.

Thus, one object of this invention is to provide an improved process for recovery of oil from tar sands.

Another object of this invention is to reduce the size of the equipment used in the process for recovery of oil from tar sands.

A further object of the invention is to reduce the energy requirements in the process for recovery of oil from tar sands.

Still another object of the invention is to recover bitumen contained in the kerosine wash.

Still another object of the invention is to provide for a more efficient reflux in the upper section of the fractionation zone.

Other objects of the invention will become apparent to those skilled in the art upon studying this disclosure.

BRIEF DESCRIPTION OF THE DRAWING

The FIGURE depicts a schematic diagram of the improved process for the recovery of oil from tar sands.

SUMMARY OF THE INVENTION

In accordance with one aspect of the invention, tar sand is blended in a melt tank with oil to form a slurry. The slurry is subdivided in a centrifugal zone into two streams, one containing coarse sand particles and the other containing fine sand particles. The stream containing coarse sand is passed through a solid separation zone in which sand is removed therefrom. Any residual bitumen is removed from solids by kerosine. The kerosine wash is combined with the filtrate stream. The stream containing fine solid particles is introduced into a coker where sand particles act as nuclei in the formation of coke. The vapor stream produced in the coker is introduced into the bottom section of the fractionator thereby supplying most of the heat requirements for product separation. The filtrate of the fine sand stream is fed into the fractionator at intermediate points. The fractionator produces gas and oil fractions, which are recovered as products. Heavy gas oil can be recycled to the melt tank and heavy bottoms can be recycled to the coker. Kerosine from the kerosine wash promotes reflux in the upper section of the fractionation zone.

Other aspects of the invention will become apparent to those skilled in the art upon studying this specification and the appended claims.

DETAILED DESCRIPTION OF THE INVENTION

The present invention provides an improved process for the recovery of oil from tar sands. The features of the invention include feeding the vapors from the coker to the bottom of the fractionator so as to utilize the energy of that stream for reboiling of the fractionator. Also included in the invention, is stripping the sand removed by the hot oil filter with kerosine and introducing kerosine wash to the fractionator to help reflux the upper section of the column. Furthermore, the refluxing action in the fractionator is used to scrub out fines entrained in the feed streams so that the final products (gasoline, kerosine, and light gas oil) withdrawn well above the point of introduction of feed streams are free of fines. The fines are confined to recycle products (heavy gas oil and heavy bottoms).

Now referring to the figure which depicts the preferred embodiment of the invention, suitably pulverized tar sand is introduced to the melt tank 10 by 15 and blended therein by agitator 18 with a suitable starting solvent such as gas oil or diesel fuel introduced by 20. If necessary, to aid in dissolution of bitumen from the sand the blend can be heated by passing heating liquid through a jacket 25. Water contained in the sand is evaporated from the melt tank removed by 12 condensed and disposed of. Once the slurry becomes pumpable, it is transported to a centrifugal classifier 30 via 35. In the centrifugal classifier the slurry is subdivided into an overflow stream 40 containing fine sand particles and an underflow stream 45 containing coarse sand particles. Although any of a variety of classifiers (described, for example, in "Unit Operations of Chemical Engineering", by W. L. McCabe and J. C. Smith, 2d Edition, pages 930–931, copyright 1967, McGraw-Hill) can be used in connection with this invention, a Dorr-Oliver, Inc. classifier is usually employed.

The choice of the optimum cut diameter ($D_{pc}$) (particles having diameter above which being included in stream 45 and particles having diameter below which being included in stream 40) is determined by the relative ease of separation of the solids from these two resulting streams. For example, if filtration is the mode by which the coarse particle stream (45) is treated and it is found that filtration rates drop off drastically when particles of a diameter less than about 50 microns are included in this stream, then the cut diameter at the centrifugal classifier should be adjusted to a size somewhat larger than 50 microns. Depending upon the specific application, cut diameters could range from as low as about 1 micron to a high of about 100 microns. The resulting weight ratio of solids in the fine solids stream to those in the coarse solids stream are entirely a function of the particle size distribution of the raw material and the optimum cut diameter selected.

Coarse solids are removed in a coarse solids removal zone which comprises a hot oil filter 50. The details of the operation of hot oil filters (also referred to as rotary drum filters) can be found, for example, in *Chemical Engineers' Handbook* by Robert H. Perry, 5th Edition, McGraw-Hill (1973). The sand trapped in the filter 50 is washed with kerosine introduced by 51. Make-up kerosine is brought by 52. The washed sand is passed into a sand drier 53 via 54 and therein organic materials are vaporized and sand is taken out of the system by 55. The essentially particle-free filtrate of stream 45, kerosine wash and vaporized organic materials brought from the drier 53 by 56 are passed via 60 to a heater 62 and therefrom via 62 to the mid-section of the fractionator 65. Therein kerosine helps to reflux the upper section of the column and to scrub out entrained fine sand particles that may have entered via vapor stream 90. The amount of heat supplied by heater 62 is sufficient to maintain the temperature which permits under the pressure maintained in the fractionation zone 65 separation of materials introduced therein into an overhead, intermediate cuts and bottoms.

The overflow stream 40 is passed into a coker preheat furnace 70 and from there it is introduced to coker drum 80 via 75. In the coker drum 80, the stream is separated into coke formed around sand particles acting as nuclei and vapors. The coke is withdrawn by 85 and vapors are withdrawn by 90. A more detailed description of the coking process can be found, for example, in "Diagram of Delayed Coking Process" by W. L. Nelson, Petroleum Refinery Engineering, McGraw-Hill (1958). Vapor stream 90 is fed into the bottom of the fractionator 65 to supply the heat for reboiling. Further heating is provided by live superheated steam introduced by 92.

The fractionator 65 is maintained at such operating conditions as to separate the feed into overhead, intermediate cuts of kerosine, light and heavy gas oils and heavy bottoms. The overhead comprising mainly gas, steam and gasoline is taken off by 93 and passed through a condenser 95 to an accumulator 100. Gas is removed from the accumulator by 110; water is removed by 115 and gasoline stream withdrawn by 120 is subdivided into 125 and 130. The former is recovered as product and the latter is returned to the top of the column as reflux. The light gas oil cut taken off by 150 is recovered as product. A part of the kerosine stream 140 is recycled via line 51 to the hot oil filter 50 and the rest is withdrawn as product via 142. A portion of the heavy gas oil withdrawn by 170 is recovered as product via 175 and a portion thereof is recycled by 180 to the melt tank 10. The heavy oil cut is recycled via 180 to the melt tank 10 and heavy bottoms stream 190 is recycled to the furnace 70 via 40.

In operation the tar sand introduced to the melt tank is usually crushed by such means as ball mill, hammer mill or jaw crusher so that it contains no "clumps". The start up solvent can be gas oil, diesel fuel or other oil; after the start up the heavy gas oil recycled by 180 is used as solvent. The relative amounts of oil and tar sands vary depending on the properties of the tar sands and the type of oil used; however, in general the amounts should be selected to produce a pumpable blend. Usually a blend containing about 10–70% by weight of oil is required. Since the preferred temperature of the melt tank ingredients is in the range of from about 250° F (121° C) to about 500° F (260° C) and usually between 250° F (121° C) and 400° F (204° C), it is preferred during start up to supply the heat to the system by circulating heating liquid through the jacket 25. After the system is operating, it is rarely necessary to supply additional heat as essentially all oil supplied to the slurry is the heavy oil recycled via 180 the temperature of which is in the range of 600°–700° F (316°–371° C). In some operations, it may be necessary to cool the slurry contained in the melt tank 10 so that the temperature of the stream 35 as it enters the hot oil filter 50 is in the preferred range from about 300°–500° F (149°–260° C).

The following calculated example is included to further illustrate the practice of the invention and is not intended to limit the scope of the invention in any manner.

EXAMPLE

In the system as shown in the FIGURE 50,000 tons per day (TPD) of tar sand containing 11 weight percent of bitumen, 83 weight percent of sand and 6 weight percent of water is introduced into a melt tank 10 where a slurry is produced with oil recycled from the fractionator at a rate of 50,000 TPD. The melt tank 10 is maintained at 400° F (204° C) temperature sufficient to evaporate 3,000 TPD of water. The slurry is passed from the melt tank at a rate of 97,000 TPD to a centrifugal classification zone 30. The melt tank stream 35 entering zone 30 comprises 41,500 TPD of sand and 55,500 of organics. The classification subdivides the melt tank stream 35 into an overflow stream 40 comprising 8,060 TPD of flow and an underflow stream 45 comprising the remainder of the melt tank slurry: 39,010 TPD sand and 49,930 organics. The overflow stream 40 contains 2,490 TPD of sand having diameter equal or less than 44 microns; sand of that diameter comprises about 6 weight percent of the total sand in the slurry. The underflow stream 45 is introduced into the hot oil filter 50 having filter area of 48,000 ft.$^2$ which retains coarse solids so that the filtrate stream leaving the hot oil filter contains 39 TPD solids and 53,571 organics. The solids trapped by the oil filter 50 are washed with a kerosine wash 51 introduced to the filter at the rate of 5,000 TPD. A portion of the kerosine wash is combined with the filtrate stream and portion (1,559 TPD) is removed from the hot oil filter 50 together with the sand (38,971 TPD). The filter cake removed from the hot oil filter is then introduced into a sand drier 53 from which 1,520 TPD of kerosine and any water contained therein is evaporated and 38,971 TPD of sand together with 39 TPD of organics are removed from the system by 55.

The filtrate stream together with kerosine wash and evaporated kerosine stream 56, comprising together 39 TPD solids and 53,371 organics, is heated in heater 62 and introduced into the mid-section of the fractionator 65. The overflow stream 40 is heated in preheat furnace 70 and introduced to a coker 80 where 1,255 TPD of coke is formed around sand particles acting as nuclei and from which 9,315 TPD vapor is withdrawn by 90 and fed to the bottom of the fractionator 65 where its heat is used for reboiling the column. The bottom temperature of the column is maintained at 650° F (343° C); the pressure is 20 psia (138 KPa). Superheated steam is added at the rate of 9 moles per mole of hydrocarbon vapor to reduce the hydrocarbon partial pressure to 2 psia (13.8 KPa). The feed is separated into various fractions taken off from the column in the following amounts:

| | tpd |
|---|---|
| 110 Non-condensible gases | 372 |
| 125 400 EP Gasoline | 1630 |
| 140 Kerosine | 1080 |
| 150 product LGO | 700 |
| 170 Product HGO | 463 |

The heavy gas oil is recycled to the melt tank at the rate 50,000 TPD, and the heavy bottoms is recycled to the coker at the rate of 5,000 TPD. Kerosine is recycled to the hot oil filter at the rate of 5,000 TPD.

I claim:

1. A process for recovering oil from tar sands which comprises:

a. blending in a mixing zone tar sand with a sufficient amount of solvent oil to make a flowable slurry;

b. subdividing said flowable slurry in a subdividing zone into an underflow stream containing coarse sand particles and an overflow stream containing fine sand particles;

c. passing the underflow stream through a solids removal zone to remove coarse sand particles contained therein;

d. introducing the overflow stream into a coking zone and therein subjecting it to such conditions as to produce coke and vapors;

e. feeding the vapors produced in step (d) and the underflow stream after it passes the solid removal zone into the bottom section and the midsection of a fractionation zone respectively;

f. maintaining such temperature and pressure in said fractionation zone as to separate the feed introduced therein into cuts including an overhead comprising mainly gas, gasoline and water, a first intermediate cut comprising mainly kerosine, a second intermediate cut comprising mainly light gas oil, a third intermediate cut comprising mainly heavy gas oil and heavy bottoms comprising mainly high boiling fractions; and, g. withdrawing each of the cuts as a separate stream from said fractionation zone.

2. A process as claimed in claim 1 further comprising:

h. recycling heavy bottoms from the fractionation zone to said coking zone; and i. transporting heavy gas oil from the fractionation zone to the mixing zone.

3. A process as claimed in claim 2 further comprising j. heating the underflow stream after it passes from the solids removal zone but before it enters the fractionation zone to provide a portion of the heat necessary for separtion of step (f).

4. A process as claimed in claim 1 further comprising k. washing the solids removed in step (c) with kerosine to remove residual bitumen therefrom and combining the resultant kerosine wash with the underflow stream after said stream passes through the solids removal zone.

5. A process as claimed in claim 3 further comprising k. washing the solids removed in step (c) with kerosine to remove residual bitumen therefrom; and, l. combining the resultant kerosine wash with the underflow stream after said stream passes through the solids removal zone.

6. A process as claimed in claim 5 further comprising m. using at least a portion of the kerosine withdrawn in step (g) for washing in step (k).

7. A process as claimed in claim 6 further comprising n. conveying solids washed in step (k) to a drying zone and therein subjecting said solids to such temperature and pressure as to evaporate essentially all kerosine and bitumen trapped therein; and o. allowing kerosine and bitumen from stem (m) to combine with the underflow stream after said underflow stream passes through the solids removal zone but before said stream enters the fractionation zone.

* * * * *